United States Patent [19]

Perez et al.

[11] Patent Number: 4,654,078

[45] Date of Patent: Mar. 31, 1987

[54] METHOD FOR RECOVERY OF PRECIOUS METALS FROM DIFFICULT ORES WITH COPPER-AMMONIUM THIOSULFATE

[76] Inventors: Ariel E. Perez, Paseo de la Arboleda #30, Col. Valle Grande; Hector D. Galaviz, Calle Rio Grande #130, Col. Nacameri, both of Hermosillo Sonora, Mexico, 83000

[21] Appl. No.: 754,827

[22] Filed: Jul. 12, 1985

[51] Int. Cl.[4] ..... C22B 11/04

[52] U.S. Cl. ..... 75/118 R; 75/2; 75/101 R; 75/103; 75/109; 75/115; 423/32; 423/33; 423/36; 252/514

[58] Field of Search ..... 423/32, 33, 36; 252/514; 75/103, 101 R, 118, 109, 2, 115

[56] References Cited

U.S. PATENT DOCUMENTS 4,070,182 1/1978 Genik-Sas-Berezowsky ..... 423/36

4,269,622 5/1981 Kerley, Jr. ..... 423/33

4,369,061 1/1983 Kerley, Jr. ..... 423/32

*Primary Examiner*—John Doll

*Assistant Examiner*—Robert L. Stoll

*Attorney, Agent, or Firm*—Cahill, Sutton & Thomas

[57] ABSTRACT

Precious metals such as gold and silver are recovered from difficult-to-treat ores, especially those containing manganese and/or copper, by lixiviating the ores using copper-ammonium thiosulfate in which the pH of the lixiviating solution is maintained at a minimum level of 9.5 in order to inhibit the action of metallic iron and its ferric salts that are present in the solution and which decomposes the double salt of copper-ammonium thiosulfate. Copper cement is used in a subsequent precipitation process to expose a large amount of area on which the gold and silver can precipitate without also causing precipitation of copper from the lixiviant solution.

11 Claims, 1 Drawing Figure

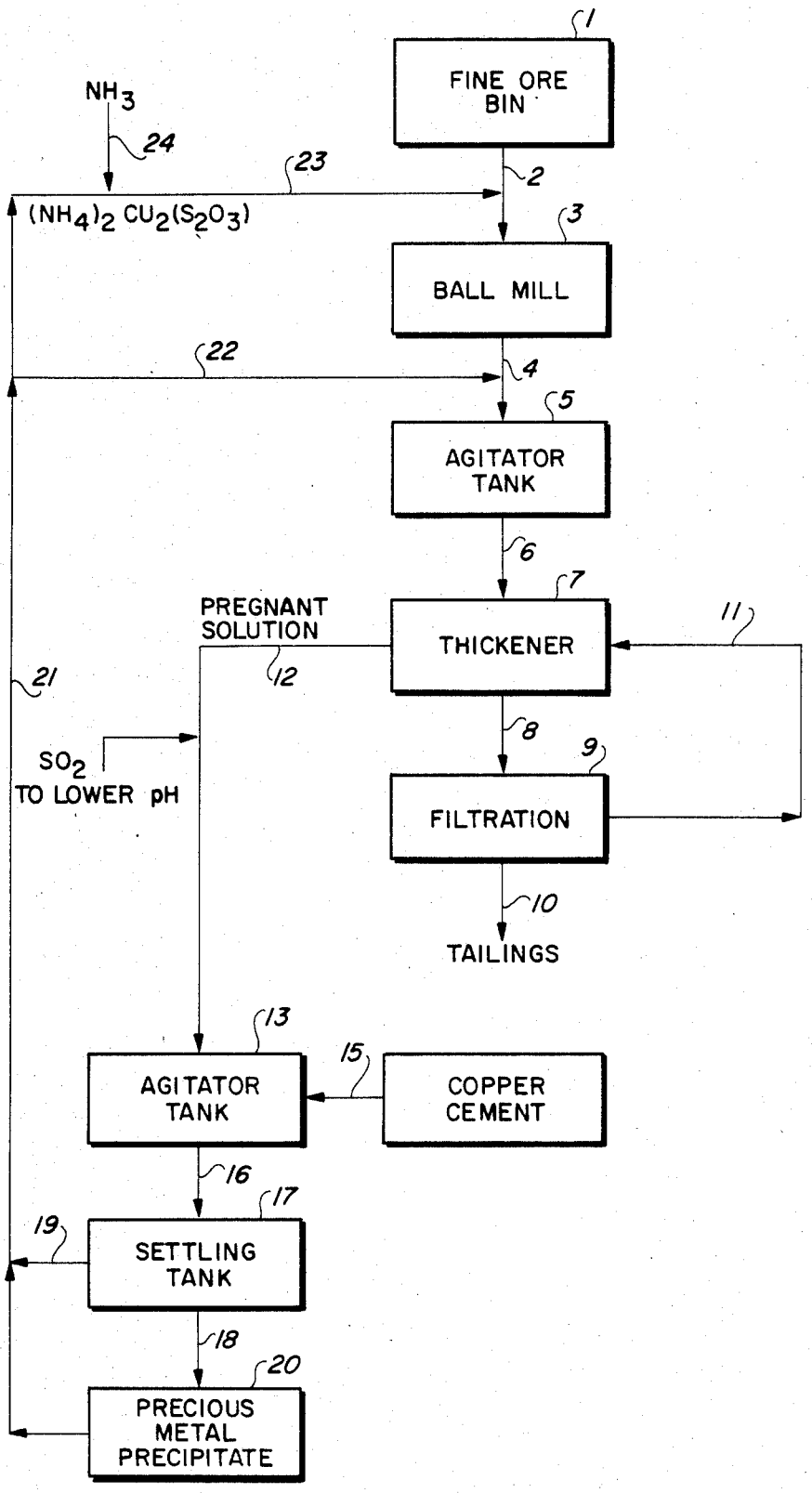
1
FINE ORE BIN
NH3
24
23
2
(NH4)2 CU2(S2O3)
3
BALL MILL
22
4
5
AGITATOR TANK
6
7
PREGNANT SOLUTION
THICKENER
11
21
12
8
9
SO2 TO LOWER pH
FILTRATION
10
TAILINGS
13
15
AGITATOR TANK
COPPER CEMENT
16
17
19
SETTLING TANK
18
20
PRECIOUS METAL PRECIPITATE

METHOD FOR RECOVERY OF PRECIOUS METALS FROM DIFFICULT ORES WITH COPPER-AMMONIUM THIOSULFATE

BACKGROUND OF THE INVENTION

The invention relates to extraction of precious metals, including gold and silver, by a leaching process from minerals that are difficult to treat by the cyanide process, and especially relates to overcoming problems associated with metallic iron that is present in a copper-ammonium thiosulfate lixiviating solution in a large scale processing plant.

Extraction of precious metals by lixiviation commonly is performed by using cyanide solutions, mainly sodium cyanide. Because cyanides are so highly toxic and cause substantial environmental problems, the use of cyanides is now falling into disfavor. Moreover, cyanides are costly materials. This makes their use economically disadvantageous. Furthermore, the use of cyanide solutions is at best difficult, and sometimes is impossible for some ores, especially those containing copper and/or manganese, because the latter materials easily contaminate the cyanide. Such materials as copper and manganese are frequently present in the ore to such an extent that high reagent loss is experienced, along with poor recoveries of the precious metals.

With respect to the last mentioned problem, there are many difficult-to-treat ores in existence which contain manganese, copper oxides and significant quantities of silver and/or gold. It would be very desirable to extract precious metals from such difficult-to-treat ores, if a suitable and sufficiently inexpensive technique were known for such recovery. However, present techniques simply are not adequate, so these difficult-to-treat ores remain an untapped mineral resource. One such source of difficult-to-treat ores containing precious metals is tailings from previously processed ores that were subjected to prior inefficient extraction processes, such as cyanide processes.

Copper sulfide containing ores such as calcocite and chalcopyrite often contain small quantities of gold and silver which it is desirable to recover. Although the problem of recovering such precious metals, in addition to recovering the copper, has received considerable attention, much of the work carried out in this connection insofar as commercial processing is concerned has involved the recovery of precious metals using pyrometallurgical processes for the recovery of copper.

One attempt to solve the above-identified problems is disclosed in the Genik-Sas-Berekowski et al. U.S. Pat. No. 4,070,182. This patent proposes the use of ammonium thiosulfate as a secondary leach for recovery of silver and gold, in conjunction with a hydrometallurgical process for the recovery of copper from the copper-bearing sulfidic ore. FIG. 3 of that patent shows a flow diagram for the extraction of precious metals from chalcopyrite concentrate before the main leaching step for extraction of copper. However, U.S. Pat. No. 4,070,182 appears to provide no suggestion as to how to maintain the thiosulfate radical stable, and it does not even appear to recognize the problem of thiosulfate instability. A time-related instability causing loss of recovery is mentioned but no reason therefore is suggested, nor is any solution proposed. The treatment of raw ores generally requires more time for a satisfactory recovery than is allowed in treating the sulfidic concentrates or residues Cs described in U.S. Pat. No. 4,070,182. That patent does not clearly teach the necessity of maintaining an alkaline pH in the thiosulfate leach liquor when starting with a raw ore, although the need for an alkaline pH is mentioned in conjunction with thiosulfate extraction following a copper recovery leach. Furthermore, the foregoing patent provides no guidance with respect to the extraction of precious metals from difficult, raw untreated ores, and more importantly, ores containing manganese.

U.S. Pat. Nos. 4,269,622 and 4,369,061 by Kerley, Jr. go further than U.S. Pat. No. 4,070,182 by describing a process in which the difficult-to-treat ores are treated by lixiviation in ammonium thiosulfate solutions containing copper with at least a trace of sulfite ions to extract gold and silver. After the lixiviation has been completed, recovery of the precious metals from the leach liquor is carried out using techniques that are conventional for recovering precious metals from cyanide solutions, such as by use of metallic zinc, iron or copper, by electrolysis, or by the addition of soluble sulfides to recover a sulfide precipitate. The stripped ammonium thiosulfate solution is then rejuvenated and can be recycled for re-use. The Kerley, Jr. process is described as being advantageous for recovery of gold and silver from difficult-to-treat ores such as those contaminated by copper and/or manganese. The Kerley, Jr. patents teach that some copper must be present for good recovery and also teach that it is desirable to maintain the pH of the leach solution in the range from at least 7.5, and preferably 8. Sulfite ions are provided by the Kerley references by adding ammonium sulfite or ammonium bisulfite to the leaching solution to inhibit decomposition of the thiosulfate. The lixiviation is taught to be preferably carried out at a temperature of 50° to 60° Centigrade. Kerley, Jr. teaches that temperatures below 40° Centigrade adversely effect the speed of the process. On the basis of the favorable results obtained in laboratory experiments using the process of the Kerley, Jr. U.S. Pat. No. 4,269,622, a very large amount of capital was spent building a large plant in Mexico to carry out the invention disclosed in the Kerley patent. Unfortunately, although the process worked well in a laboratory environment, we were unable to ever get the process to work in the above mentioned plant, despite extensive consultation with the inventor, Mr. Kerley.

Subsequent to the failure of the process disclosed in the Kerley, Jr. patent to operate in the constructed plant, we, with the expenditure of a large amount of money, worked for over two years modifying the process of U.S. Pat. No. 4,269,622, attempting to develop a technique that would economically leach gold and silver from available difficult-to-treat ores. Only after many man-hours of effort and after expenditure of a great deal of money were we able to develop the modified process of the present invention so that it would be operative in a large plant.

SUMMARY OF THE INVENTION

Accordingly, it is an object of the invention to provide a process for recovery of precious metals that is operable in a large ore processing plant including a ball mill without the use of prior conventional cyanide solutions.

It is another object of the invention to provide a process for recovering precious metals including gold and silver by using an improvement to the processes disclosed in U.S. Pat. Nos. 4,269,622 and 4,369,061 such that the action of metallic iron in the solution is inhibited.

Another object of the invention is to improve the extraction of precious metals contained in minerals of difficult treatment, particularly those containing copper and/or manganese, with emphasis on those containing manganese, without using prior cyanide solution leaching processes.

Briefly described, and in accordance with one embodiment thereof, the invention provides a method for the recovery of precious metals, including silver and/or gold, from a difficult-to-treat ore, especially an ore containing manganese and/or copper, by lixiviating the ore in copper-ammonium thiosulfate in which the pH is maintained at a minimum level of 9.5 in order to inhibit the action of substantial amounts of metallic iron that are present in the lixviating solution as a result of grinding the ore in a ball mill prior to lixiviating. Copper cement is introduced into a pregnant solution removed from the lixiviating solution after the lixiviating step is complete in order to expose a large amount of surface area on which the precious metals can precipitate and also to maintain a minimum level of copper ions in the copper-ammonium thiosulfate solution, which is recycled by removing the solids and then is re-used for lixiviating of additional amounts of the ore. Anhydrous ammonia is added to the copper-ammonium thiosulfate solution to maintain the pH at at least 9.5, but preferably in the range from 10.0 to 10.5. The temperature of the lixiviating solution is maintained at room temperature, i.e., in the range from 25 to 40 degrees Centigrade.

BRIEF DESCRIPTION OF THE DRAWING

The sole FIGURE is a flow chart useful in describing the process of the present invention and the plant in which that process is performed.

DESCRIPTION OF THE INVENTION

To solve the previously mentioned problems of cyanidation and to solve the problems associated with the processes of the Kerley, Jr. patents referred to above, wherein the process is operative in laboratory experiments but is not operative in a processing plant that was constructed to perform the process on a large scale, the present invention uses copper-ammonium thiosulfate in the leaching process, and adds anhydrous ammonia to maintain pH at a level of at least 9.5. This process achieves comparatively better recovery with much less time of mineral solution contact. Copper cement is used to efficiently precipitate the precious metals without precipitating copper from the lixiviating solution, which is filtered and re-used without replenishment.

Copper-ammonium thiosulfate is a low cost, nontoxic reagent which can be used in more concentrated solutions than cyanide. The concentrations can be as high as 60% copper-ammonium thiosulfate in the lixiviating solution. The subsequently described examples show that in the process of the present invention, the most satisfactory range covers concentrations from 5% to 15% copper-ammonium thiosulfate. In general, however, as the concentration of the solution increases, the leaching process is accomplished in less time. In ores of easy treatment, concentrations as low as 2% copper-ammonium thiosulfate can be used in accordance with the present invention.

As noted in the above-referenced Kerley, Jr. patents, the presence of copper is necessary in the lixiviant solution. If the solution does not contain copper from the ore or mineral from which the precious metals are to be extracted, it is necessary to add copper in the form of a salt or other compound to increase the concentration of copper to the range of 1 to 4 grams per liter, as is taught by U.S. Pat. No. 4,070,182. A certain level of sufite ions in the solution, as indicated by Kerley, Jr., as an excess of sulfite may prevent the precipitation of sulfur which carries with it the silver like sulfide.

If, however, at the same time a high pH is maintained in the lixiviating solution, the above-indicated copper concentration can be reduced.

In accordance with the present invention, in order to achieve stability of the values of gold and silver in the solution, it is necessary to maintain an absolute minimum pH of 9.5. Preferably, the pH should be maintained in the range from 10.0 to 10.5. The benefit of maintaining a pH of at least 10 is that it prevents the decomposition of copper-ammonium thiosulfate by iron and its compounds. If such decomposition of copper-ammonium thiosulfate occurs, due to iron particles that are present in the lixiviating solution as a result of the normal grinding operation of the ball mill, the extraction of the gold and silver will be impeded.

What is meant by the stability of the values of gold and silver is that the gold and silver complex ions in solution are "fixed" in the liquor, unless an element or chemical compound is added that reacts with them, removing them from dissolution. The decomposition of the silver and gold complex ions is avoided at levels of pH higher than 9.5. If iron is present, it is dissolved into the solutions at pH levels lower than 9.5, destroying the thiosulfate ion produced. Instead, by oxidation, the tretrathionate ion ($S_4O_6^{2+}$) which has no lixiviating action on silver and gold is produced. All other precious metals form the same kind of complex ions with thiosulfate, so it is expected that their decomposition is also avoided by keeping the pH higher than 9.5 for the same reasons.

The above-mentioned damaging action of such metallic iron and its compounds is illustrated by the two following reactions:

$$2S_2O_3^{--} + 2Fe^{+++} \longrightarrow 2Fe^{+++} + S_4O_6^{--}$$

$$FeO + Ag_2S_2O_3 \longrightarrow AgS + FeSO_4.$$

The presence of a high pH in the solution stabilizes the thiosulfate ion, precipitating the iron compounds, and thereby preventing the iron compounds from displacing the silver and gold from solution. This therefore maintains the precious metals in solution and accelerates the dissolution of them. Using the techniques of the present invention, the dissolution times for the precious metals in solution are typically in a range of 1.5 to 2.5 hours. As explained in U.S. Pat. No. 4,269,622, once dissolution of the precious metals into the lixiviating solution has been accomplished, recovery of the precious metals from the pregnant solution can be carried out by conventional methods using zinc, iron, metallic copper or soluble sulfides.

With respect to the copper-ammonium thiosulfate, the zinc, iron and soluble sulfides have the disadvantage of decreasing the concentration of copper ions in the lixiviant solution, as explained in more detail later, and they also produce very impure precipitates which are very difficult to treat for extracting the precious metals.

In accordance with the present invention, use of copper cement, or metallic copper powder selectively precipitates the precious metal, but does not decrease the concentration of copper ions in the lixiviating solution as do the other conventional techniques for precipitating silver and gold. Instead, the copper cement actually increases the copper ion concentration in the solution. Depending on the concentrations of the precious metals in the solution, from 1 to 6 grams of copper per liter of solution may be added during the precipitation process to obtain the desired precious metal precipitate. The copper cement used includes a mixture of copper oxides, elemental copper and also some iron oxides. Those skilled in the art are well aware of the chemical reactions of the precipitation of gold and silver with copper cement, which therefore are not set forth.

In order to perform testing to confirm the above-described process for recovery of gold and silver by lixiviating difficult-to-treat ores in copper-ammonium thiosulfate solution, maintaining the pH at a level of at least 9.5, and maintaining adequate amounts of copper ions in the lixiviating solution, tests were conducted both in a laboratory environment and in a pilot plant built specifically to extract precious metals from residual tailings of an old cyanidation plant located in the town of LaColorada, in the state of Senora, Mexico. The tailings particles were roughly 80 percent 200 mesh particles. The assay of the mineral heads (i.e., the minerals fed to the processing plant) tested were: gold, 1.0 grams per ton; silver, 120 grams per ton; manganese, 1.35%; and copper, 0.1%. The layout of the pilot plant is shown in the sole FIGURE. The pilot plant includes a fine ore bin 1 in which tailings of the old cyanidation process are held. Tailings are conveyed through path 2 to a ball mill 3. Re-grinding of the tailings is necessary to increase the amount of surface area of the ore exposed to the lixiviating solution. As indicated in the FIGURE, before the ore reaches ball mill 3, copper-ammonium thiosulfate solution and water are added to the ore until the concentrations are as indicated in the subsequently described examples. Anhydrous ammonia ($NH_3$) is added to the copper-ammonium thiosulfate, as indicated by arrows 24, to maintain the pH at a level of at least 9.5.

After grinding in the ball mill for approximately 30 minutes to bring the ore particle sizes down to approximately 200 mesh, the material coming out of the ball mill 3 is a slurry containing approximately 70% solids. After the ball mill operation, the viscosity of the slurry is lowered by adding more water and ammonium thiosulfate solution, as indicated by path 22, to bring the percentage of solids in the slurry down to about 40%. This lowers the pH to roughly 8 or 9. The slurry is fed into agitator tanks 5, as indicated by path 4. An agitation step is performed in the tanks 5 because it is necessary to keep the chemical reaction going for the extraction of the silver and gold by the lixiviating solution.

After the agitating the slurry for approximately 1.5 to 2.5 hours, the slurry goes by a path 6 to a thickening tank 7. At this stage, as much gold and silver are already in the lixiviating solution as is practical to recover by the process of the invention. At this stage, it is necessary to remove the pregnant solution from the solids. The next step in the process is to conduct the pregnant solution into an agitator tank 13 via path 12 to begin a precipitation process to precipitate the gold and silver from the pregnant solution. Copper cement from a container 14 is fed via path 15 into agitator tank 13 because, as indicated above, it is desirable to have copper cement in the solution in order to precipitate the gold and silver out of the solution. A paper by K. Tozawa, et al. "Dissolution of Gold in Ammonical Thiosulfate Solution", Paper No. A81-25, published by The Metallurgical Society of AIME, P.O. Box 430, 420 Commonwealth Drive, Warrendale, Pa. shows the basic steps of recovery of gold from ammonium thiosulfate solutions and discusses use of copper and the effects of agitation or dissolving of silver and gold. However, this reference does not recognize or discuss the problem of iron in the solution and how to solve that problem.

The agitated solution is passed via path 16 to settling tank 17 and allowed to settle for an adquate time. Precious metal precipitate is removed via path 18 into a container 20. Some of the lixiviating solution from which the precious metals are precipitated is carried out of settling tank 17 via path 19 to path 21. The precious metal precipitate 20 then is processed to remove the precious metals.

The thickened slurry left in tank 7 by removal of the pregnant solution passes via path 8 to a EIMCO belt filter 9, which removes and discards tailings from the thickened slurry and returns the filtered silver, gold copper-ammonium thiosulfate solution via path 11 back to the thickener 7. The solution is driven back into the thickener 7 because the solution still contains values of precious metals which have to be recovered later, in the precipitation steps.

Before describing specific examples of the precise processing of the above-identified mineral samples, the underlying chemical reactions will be described.

An imporant requirement for the present invention is to maintain a pH preferably in the range of alkalinity of 10 to 10.5, but at least 9.5. In order to maintain this pH, the anhydrous ammonia is added to stabilize the thiosulfate solution, as indicated by equation (1) below:

$$4SO_3^{=}+2S+6H^{+}\rightleftarrows 3S_2O_3^{=}3H_2O. \quad (1)$$

This reaction releases $OH^-$ radical groups.

If the pH is alkaline, the reaction goes to the right in equation (1). The presence of the $OH^{-0}$ ion is necessary in order to inhibit the deleterious effects of compounds which destroy the thiosulfate. In accordance with the present invention, it has been discovered that the above mentioned metallic iron compounds are present in the lixiviating solution, and come both from the ore or tailings itself and from the grinding action of the ball mill.

Hematite is the more common mineral in the ores from which we are trying to recover precious metals. Hematite reacts with the thiosulfate ion, as indicated by the following equation:

$$Fe_2O_3.xH_2O+2S_2O_3^{=}\rightleftarrows Fe^{++}+S_4O_6^{=}+x\text{-}H_2O+3/2\ O_2. \quad (2)$$

The ferric ion is reduced to a ferrous ion and the thiosulfate ion is oxidized to product tetrathionate ions. The tetrathionate ions are not renewable. This is the $S_4O_6$ ion.

The reactions of equations (3) through (6) below show the reactions of the metallic iron in the lixiviating solution as a result of grinding the ore by the ball mill processing equipment.

$$4Fe \rightarrow 4Fe^{++} + 8e^- \quad (3)$$

$$8e^- + 8H^+ \rightarrow 8H \quad (4)$$

$$8H + 2O_2 \rightarrow 4\ H_2O \quad (5)$$

$$4Fe^{++} + O_2 + (4+2x)H_2O \rightarrow 2(F_2O_3.xH_2O) + 8H^+. \quad (6)$$

The complete reaction is indicated by equation (7):

$$4Fe + 3O_2 + 2xH_2O \rightarrow 2(F_2O_3.xH_2O). \quad (7)$$

Here, metallic iron plus water and oxygen react to form hematite, which is undesirable because it causes precipitation of silver and gold.

The ultimate compounds could react with the iosulfate, according to equation (2) above. The deleterious effect of the iron can be avoided by addition of anhydrous ammonia into the solution, causing formation of ammonium hydroxide, as indicated in the following equation:

$$NH_3 + H_2O \leftrightarrows NH_4^+ + OH^-. \quad (8)$$

The reaction of ammonium hydroxide with the ferrous ions interrupts the chain formation of the $Fe_2O_3.xH_2O$ according to the following equation:

$$Fe^{++} + 2NH_3 + 2H_2O \rightleftarrows Fe\ (OH)_2 + 2NH_4^+. \quad (9)$$

This equation represents adding anhydrous ammonia to get the pH of the lixiviating solution in the range from 10 to 10.5, preferably.

The ferrous hydroxide formed in reaction (9) reacts with the oxygen in the solution, forming ferric hydroxide, which precipitates according to the following equation:

$$4Fe(OH)_2 + O_2 + 2H_2O \rightarrow 4Fe\ (OH)_3 \downarrow. \quad (10)$$

This reaction causes the iron to precipitate out. The ferric hydroxide is removed with the leached or lixiviated material. The ferric hydroxide is removed with the mineral tails from the thickening tank 7 in the FIGURE via path 8 and filtered out.

Also, the ammonium hydroxide produced in reaction (8) impedes the precipitation of silver leached in the form of silver sulfide. This means that the silver precipitates out of solution in the form of silver sulfide when oxides of calcium, iron, manganese or copper are present; equations (11) through (14) represent the reactions of such precipitation, and are examples of undesirable loss of silver by precipitation into silver sulfide.

$$CaO + Ag_2SO_3 \rightarrow Ag_2S + CaSO_4 \quad (11)$$

$$Fe_2O_3 + 2Ag_2S_2O_3 + 2H^+ \rightarrow 2Ag_2S + FeSO_4 + H_2O \quad (12)$$

$$CuO + Ag_2S_2O_3 \rightarrow Ag_2S + CuSO_4 \quad (13)$$

$$MnO_2 + Ag_2\ S_2O_3 \rightarrow Ag_2S + MnSO_4 + \tfrac{1}{2}O_2. \quad (14)$$

Gold is precipitated out in essentially similar reactions.

The foregoing reactions are avoided by addition of ammonia to raise the pH to at least 9.5 but preferably 10.0 to 10.5. Equations (15) through (18) show this:

$$Ca^{++} + 2NH_4OH \rightarrow Ca(OH)_2 + 2NH_4^+ \quad (15)$$

$$Fe^{+++} + 3NH_4OH \rightarrow Fe(OH)_3 \downarrow + 3NH_4^+ \quad (16)$$

$$Cu^{+++} + 4NH_4OH \rightarrow Cu(NH_4)_4^{++} + 4OH^- \quad (17)$$

$$Mn^{+++} + 2NH_4OH \rightarrow Mn(OH)_2 \downarrow + 2NH_3^+ H2. \quad (18)$$

These equations summarize the chemical reactions of the present invention and show how addition of ammonia brings the pH up to the desired range and also causes precipitation of calcium, manganese and iron out and thereby prevent the reactions of equations (11) to (14) from occurring.

However, equation 17 shows how to keep the copper in solution, to accelerate the dissolution of silver and gold in equations (19) and (20). Also, the ammonia not only stabilizes the thiosulfate, but also accelerates the dissolution of the precious metals from the ore. Equations (19) and (20) are set forth below:

$$Ag_2S + 4NH_3 + H_2O \rightarrow 2[Ag(NH_3)_2]^+ + 2OH^- \quad (19)$$

$$Au + 4NH_3 + H_2O + \tfrac{1}{2}O_2 \rightarrow 2[Au(NH_3)_2]^+ + 2OH^- \quad (20)$$

The increase in the velocity of dissolution of the gold and silver not only permits leaching in the relatively shorter time, between 1.5 and 2.5 hours, but can be realized at room temperature with excellent results, as the following examples indicate, providing that the pH in the solution goes no lower than 10.0 during the lixiviation. The following table, Table 1, gives examples of leaching times of ore from the above mentioned La Colorada Sur Tails.

TABLE 1

| | p.p.m of Ag/Au in Solution | | | | | % of |
|---|---|---|---|---|---|---|
| Temp °C. | 30 min. | 60 min. | 90 min. | 120 min. | 150 min. | Extraction |
| 20 | 82/0.65 | 97/0.75 | 101/0.78 | 105/0.80 | 105/0.83 | 84.7/93.6 |
| 25 | 84/0.66 | 100/0.77 | 104/0.80 | 108/0.83 | 108/0.85 | 87.1/95.9 |
| 30 | 84/0.66 | 100/0.77 | 106/0.81 | 108/0.83 | 108/0.85 | 87.1/95.9 |
| 35 | 85/0.67 | 100/0.78 | 106/0.81 | 108/0.83 | 108.0.85 | 87.1/95.9 |
| 40 | 86/0.69 | 101/0.78 | 106/0.81 | 108.0.83 | 108.0.85 | 87.1/95.9 |
| 50 | 88/0.69 | 104/0.78 | 108/0.82 | 112/0.85 | 112/0.87 | 90.3/98.1 |
| 60 | 88/0.67 | 96/0.76 | 104/0.80 | 104/0.82 | 104/0.85 | 83.9/95.5 |

For Table 1, the head assays were as follows: gold, 1.33 grams per ton; silver, 186 grams per ton; manganese, 3.8%; iron, 1.75%; copper, 0.075%; CaO, 1.1%; alumina ($Al_2O_3$) 1.45%. The leaching conditions were as follows: 40% solids, pH equals 10.2, and copper content was equal to 3 grams per liter.

The above-described samples of assay minerals were prepared for testing by regrinding the samples in copper-ammonium thiosulfate solution, as indicated in Table 2.

TABLE 2

| | CATMI gr/lt | ASMI gr/lt | CU gr/lt | PH | Ag(MD) (ppm) | Laboratory Tests CATMD gr/lt | ASMD gr/lt | Ag(LD) (ppm) | CATLD gr/lt | ASLD gr/lt | EX(%) ag | AU(LD) gr/ton | EX(%) Au |
|---|---|---|---|---|---|---|---|---|---|---|---|---|---|
| P-1 | 75.8 | 80.0 | 3.0 | 8.0 | 2.0 | 50 | 60 | 4.0 | 3.0 | 50.0 | 5 | 0.92 | 8.0 |
| P-2 | 100.0 | 100.0 | 3.0 | 8.0 | 4.0 | 60 | 65 | 6.0 | 2.8 | 49.6 | 7.5 | 0.9 | 10.0 |
| P-3 | 100.0 | 100.0 | 3.0 | 10.0 | 60 | 89 | 80 | 75 | 92 | 92.0 | 93.75 | 0.05 | 95.0 |
| P-4 | 50.0 | 10.0 | 3.0 | 10.0 | 55 | 49.8 | 5.0 | 70 | 49.0 | 5.5 | 87.5 | 0.11 | 89.0 |
| P-5 | 50.0 | 100.0 | 3.0 | 8.0 | 8.0 | 35.0 | 67.0 | 6.0 | 25.0 | 50 | 7.5 | 0.81 | 19.0 |
| P-6 | 50.0 | 10.0 | 0 | 10.0 | 20 | 49.8 | 6.5 | 26 | 48.5 | 6.0 | 32.5 | 0.62 | 38.0 |
| P-7 | 100.0 | 100.0 | 0 | 8.0 | 2.0 | 38 | 30 | 2.0 | 2.0 | 22 | 2.5 | 0.95 | 5.0 |
| P-8 | 100.0 | 100.0 | 0 | 10.0 | 10.0 | 95.0 | 87 | 29 | 95.0 | 92.0 | 36.3 | 0.60 | 40.0 |
| -PILOT PLANT "MINERALES DE LA COLORADA, S.A. DE C.V. (100 TON./DAY) TEST- | | | | | | | | | | | | | |
| PPP-1 | 60.0 | 7.0 | 3.4 | 8.0 | 4.0 | 20.0 | 1.5 | 8.0 | 10.0 | — | 10.0 | 0.88 | 12.0 |
| PPP-2 | 60.0 | 7.0 | 3.4 | 9.0 | 44 | 45.0 | 3.0 | 50 | 40.0 | 1.0 | 62.5 | 0.3 | 70.0 |
| PPP-3 | 60.0 | 7.0 | 3.4 | 10.0 | 98 | 58.0 | 5.0 | 74 | 58.5 | 5.0 | 92.5 | 0.06 | 94.0 |

NOMENCLATURE:
CAT: Copper Ammonium Thiosulfate
AS: Ammonium Sulfite
Cu: Copper
Ag: Silver
Au: Gold
MI: Mill Intake
MD: Mill Discharge
LD: Leaching Discharge
EX: Extraction After 30 minutes of such grinding, the slurry contained solid material, 60% of which had a grain size of 200 mesh. (200 mesh is equal to 0.0029 inches or 0.074 millimeters.) Tests were conducted as indicated in the following examples and in Table 2 to determine which variables (such as pH, metallic copper content, copper cement content, leaching, ammonium sulfide concentration, and temperature) that most influenced the leaching processes. The liquor resulting from the above-indicated regrinding process is used in the subsequently described precipitation tests.

The leaching was performed for 90 minutes in the liquor, which included 60–70% of solid content in the grinding mill, and was diluted to 40% solid content during the leaching operations by adding water.

The results obtained from both laboratory tests and tests performed in the above-mentioned La Colorada pilot plant are found in Table 2.

The results in Table 2 show that for both the laboratory experiments and the pilot plant experiments, the recoveries of both gold and silver are very good, without any requirement for increasing the concentrations of ammonium thiosulfate and sulfite as long as the pH is maintained at a level of at least 9.5 in both the regrinding steps (in the ball mill) and in the leaching step.

The following experiments were performed to determine the efficiency of precipitation of gold and silver from the pregnant solution.

EXAMPLE 1

Two tests were made under the conditions pregnant that the concentration of silver in the pregnant lixiviating solution in path 12 in the FIGURE was 80 ppm (parts per million). The concentration of copper-ammonium thiosulfate in the pregnant solution was 60.5 grams per liter. Granular metallic copper having particular sizes between 20 and 30 mesh (0.033 inches) and containing 99.8% copper was used, in the amounts indicated in Table 3 and Table 4 below. In Table 3, the tests were made under vacuum conditions of 20 inches of mercury. In Table 4, the same experiment was repeated with granular metallic copper, without vacuum. The concentration of the discharged copper-ammonium thiosulfate in both the tests of Table 3 and Table 4 was 60.5 grams per liter.

TABLE 3

| Metallic copper in gr/liter | Silver in solution in ppm 10 min | 20 min | 30 min | Precipitation efficiency in % |
|---|---|---|---|---|
| 0.050 | 77 | 75 | 72 | 10.0 |
| 0.100 | 76 | 75 | 70 | 12.5 |
| 0.250 | 74 | 70 | 67 | 16.25 |
| 0.500 | 68 | 59 | 52 | 35.0 |
| 1.000 | 64 | 53 | 41 | 48.75 |
| 3.000 | 42 | 28 | 15 | 81.25 |
| 5.000 | 40 | 17 | 10 | 87.5 |

TABLE 4

| Metallic copper in gr/liter | Silver in solution in ppm 10 min | 20 min | 30 min | Precipitation Efficiency in % |
|---|---|---|---|---|
| 0.050 | 74 | 74 | 72 | 10.0 |
| 0.100 | 74 | 68 | 67 | 16.25 |
| 0.250 | 74 | 72 | 66 | 17.50 |
| 0.500 | 66 | 57 | 49 | 38.75 |
| 1.000 | 63 | 50 | 40 | 50.0 |
| 3.000 | 40 | 25 | 13 | 83.75 |
| 5.000 | 37 | 15 | 8 | 90.0 |

We interpreted the results of Table 3 and Table 4 to indicated that the presence of a vacuum is not necessary to obtain high precipitation efficiency. Precipitation efficiency is the degree to which silver and gold are depleted from the liquor going to precipitate-like solids, or the ratio between the amount of precipitate obtained and the amount that should be obtained if all the precious metals in the solution were precipitated.

As a result of the foregoing experimental results, we conclude that vacuum has a relatively minor influence in the efficiency of the precipitation. The next set of tests, performed with copper cement was performed without vacuum. The copper cement was first sifted to provide 70 mesh particles.

EXAMPLE 2

The above-mentioned tests for precipitation of silver by using copper cement were made at room temperature. The concentration of copper in the intake solution, i.e., pregnant solution, was maintained at 880 ppm. The concentration of silver in the pregnant solution was maintained at 80 ppm, and the concentration of ammonium thiosulfate in the pregnant solution was maintained at 60.5 grams per liter. The copper cement contained 80% copper. The results of this precipitation experiment are given in Table 5.

TABLE 5

| Copper in gr/liter | Silver in solution in ppm 2.5 min | 5.0 min | Copper in ppm 5 min | Efficiency of precipitation in % |
|---|---|---|---|---|
| 0.250 | 50 | 44 | 880 | 45.0 |
| 0.500 | 26 | 24 | 1040 | 70.0 |
| 0.750 | 12 | 8 | 1280 | 90.0 |
| 1.000 | 12 | 7 | 1480 | 91.25 |

The results of Example 2, shown in Table 5, show that a higher efficiency of precipitation of silver is achieved with copper cement than is achieved with granular metallic copper.

Several additional tests were performed to determine the feasibility of precipating silver from the pregnant solution using zinc powder, or ammonium sulfide, or the complex salt $Ag_2(S_2O_3)$, since use of these substances is common for precipitating precious metals out of cyanide lixiviating solutions. Each of these experiments showed a severe degradation in the amount of copper in the solution after 10 minutes. This loss of copper in the lixiviating solution is highly undesirable, because if this occurs the copper-ammonium thiosulfate solution must then be replenished with copper, at considerable expense before it can be re-used. The results shown in Table 5 show no degradation of the copper in the lixiviating solution when copper cement is utilized to precipitate the silver out of solution.

Table 6 below shows precipitation of both silver and gold out of the solution lixiviated in accordance with the present invention. In the test of Table 5, the lixiviating solution contained 80 ppm (parts per million) silver and 0.85 ppm gold in solution, and a level of copper cement of 1 gram per liter was maintained in the solution. Table 6 below shows the results of precipitating silver and gold out of the pregnant solution obtained by applying the above technique to lixiviate the tailings. Precipitation times were five minutes.

TABLE 6

| pH | Silver/Gold (ppm) | Precipitation Efficiency (Silver/Gold) |
|---|---|---|
| 10 | 77/0.83 | 3.75/2.35 |
| 9 | 30/0.42 | 62.5/50.58 |
| 8 | 7/.07 | 91.25/91.76 |

Table 5 shows that precipitation of the gold and silver out of the lixiviating liquor is most efficient when the pH is lowered to the range of 7.5 to 8, because at high pH levels of 9 or greater, the ammonium dilutes more copper that is normally used to replace the gold and silver in solution and thereby decreases the degree of precipitation.

CONCLUSIONS OF THE PRECIPITATION TESTS

The leaching processes for dissolution of precious metals, such as gold and silver, with copper-ammonium thiosulfate requires the presence of copper ions in the lixiviating solution. For difficult ores, the minimum level of copper for precipitation has to be approximately 1.0 to 1.5 grams per liter. For ores that are easy to treat, the level of copper can be reduced to about 0.5 grams per liter. The precipitation of silver or gold with ammonium sulfide or zinc powder, or $Ag_2S_2(S_2O_3)$ at high temperatures drastically reduces the concentration of the necessary copper ions in the pregnant solution. This causes problems of stability and dissolution capacity. The ammonium thiosulfate has dissolvent, slightly on metallic silver, and none on sulfides. The copper ammonium thiosulfate in exchange dissolves metallic silver as well as silver oxides and sulfides. The complex copper ammonium thiosulfate is unstable at high temperatures and decomposes to ammonium thiosulfate, the copper precipitates as sulfides. Without copper, the dissolution capacity of ammonium thiosulfate diminishes. The precipitation of silver or gold with granular metallic copper is not recommended, because the area of contact with the solution is very small, and the exposed area is rapidly covered with precipitated gold or silver. Moreover, due to the size of the granular metallic particles, they are of difficult solution in the ammonium thiosulfate, such that the original concentration of copper does not suffer noticeable alteration. The granular copper does not increase the cuperic ions in solution, because the area of contact thereof is rapidly covered by precious metals. Then dissolution of it does not exist, but the cuperic ion level is constant.

Our experiments show that the precipitation with copper cement has the advantages that it substantially increases the concentration of copper ions in the lixiviating solution. The use of copper cement presents sufficient area for the precipitation of gold and silver from the pregnant solution, and selectively precipitates gold and silver thereon. The resulting precipitates of silver or gold are relatively easy to treat using conventional techniques to recover the gold and silver. Finally, the use of copper cement is more economical than use of granular metallic copper.

While the invention has been described with reference to a particular embodiment thereof, those skilled in the art will be able to make various modifications to the described process without departing from the true spirit and scope of the invention.

We claim:

1. A method for the recovery of precious metals, including silver and gold, from an ore containing same, said method comprising:

(a) mixing the ore with copper-ammonium thiosulfate solution and adding anhydrous ammonia to the copper-ammonium thiosulfate solution to maintain the pH at a level of at least 9.5;

(b) grinding the ore mixed with the copper-ammonium thiosulfate solution in a ball mill after step (a), the grinding producing iron particles in the copper-aluminum thiosulfate solution;

(c) preventing the iron particles and any iron in the ore from dissolving into the copper-ammonium thiosulfate solution by adding sufficiently more copper-ammonium thiosulfate solution to the mixture to maintain the pH of the mixture at at least 9.5 and lixiviating that ore in the copper-ammonium thiosulfate solution in the first tank, and agitating the mixture during said lixiviating for at least approximately 1.5 hours;

(d) removing pregnant solution from the lixiviating solution after said lixiviating, leaving a slurry in the first tank;

(e) feeding the pregnant solution and copper cement into an agitator and agitating the mixture of pregnant solution and copper cement for at least approximately five minutes to effectuate precipitation of the precious metals on the copper cement and to maintain at least approximately one gram per liter of copper in the pregnant solution;

(f) allowing copper cement and precipitates of the previous metals thereon to settle from the mixture of pregnant solution and copper cement, and reusing the resulting copper-ammonium thiosulfate solution in step (a); and (g) filtering solid materials from the slurry left by removal of the pregnant solution in step (d) reusing the resulting copper-ammonium thiosulfate solution in step (a).

2. The method of claim 1 wherein step (a) includes maintaining the pH of the lixiviating solution in the range of 9.5 to 10.5.

3. The method of claim 1 wherein step (d) includes maintaining the thiosulfate concentration in the lixiviating solution in the range from approximately 5 percent to 15 percent.

4. The method of claim 1 wherein step (d) includes adding sufficient additional copper-ammonium thiosulfate solution to lower the percentage of solids in the mixture of ground up ore and copper-ammonium thiosulfate solution to approximately 2 percent.

5. The method of claim 1 wherein the lixiviating temperature is maintained at approximately 25 to 35 degrees Centigrade.

6. The method of claim 1 wherein step (d) includes adding 5 grams per liter of copper cement to the pregnant solution in order to precipitate the precious metals.

7. The method of claim 6 including maintaining the pH in the mixture of copper cement and pregnant solution in the range of approximately 7.0 to 8.5 during precipitation of precious metals.

8. The method of claim 1 wherein the amount of copper cement is selected to provide a concentration of copper ions in the lixiviating solution as low as approximately 1 gram per liter.

9. The method of claim 1 wherein the agitating of step (c) is continued for an interval in the range of approximately 1.5 hours to 2.5 hours.

10. The method of claim 7 wherein the agitating of step (d) is continued for an interval in the range of approximately 5 minutes to 10 minutes.

11. The method of claim 1 wherein said ore is a manganese-containing ore.

* * * * *